US009895704B2

(12) United States Patent
Gromes, Sr.

(10) Patent No.: US 9,895,704 B2
(45) Date of Patent: Feb. 20, 2018

(54) SURFACE CLEANING DEVICE AND METHOD OF OPERATION

(71) Applicant: TERYDON, INC., Navarre, OH (US)

(72) Inventor: Terry D. Gromes, Sr., Navarre, OH (US)

(73) Assignee: Terydon, Inc., Navarre, OH (US)

( * ) Notice: Subject to any disclaimer, the term of this patent is extended or adjusted under 35 U.S.C. 154(b) by 0 days.

(21) Appl. No.: 14/803,768

(22) Filed: Jul. 20, 2015

(65) Prior Publication Data

US 2017/0021395 A1 Jan. 26, 2017

(51) Int. Cl.

| | |
|---|---|
| ***B05B 3/02*** | (2006.01) |
| ***A47L 11/00*** | (2006.01) |
| ***A47L 11/40*** | (2006.01) |
| ***B05B 13/00*** | (2006.01) |
| ***E01H 1/10*** | (2006.01) |

(52) U.S. Cl.

CPC ..... *B05B 3/02* (2013.01); *A47L 11/00* (2013.01); *A47L 11/4038* (2013.01); *A47L 11/4044* (2013.01); *A47L 11/4069* (2013.01); *A47L 11/4072* (2013.01); *A47L 11/4077* (2013.01); *A47L 11/4088* (2013.01); *B05B 13/005* (2013.01); *E01H 1/101* (2013.01)

(58) Field of Classification Search

CPC ..... B08B 3/024; B08B 2203/02; B05B 3/02; B05B 13/005; A47L 11/00; A47L 11/4038; A47L 11/4044; A47L 11/4069; A47L 11/4072; A47L 11/4088; E01H 1/101

See application file for complete search history.

(56) References Cited

U.S. PATENT DOCUMENTS

| | | | | |
|---|---|---|---|---|
| 5,518,553 A * | 5/1996 | Moulder | ..... | B60S 3/008 134/167 R |
| 6,151,748 A | 11/2000 | Earhart et al. | | |
| 2013/0118529 A1 * | 5/2013 | Gromes, Sr. | ..... | B08B 3/024 134/21 |

* cited by examiner

*Primary Examiner* — Christopher Kim
(74) *Attorney, Agent, or Firm* — Sand & Sebolt

(57) ABSTRACT

A surface cleaner and method of operation are provided wherein the surface cleaner may include a rotatable nozzle assembly with one or more nozzles which may expel water onto a target surface to be cleaned.

9 Claims, 10 Drawing Sheets

SURFACE CLEANING DEVICE AND METHOD OF OPERATION

BACKGROUND

Technical Field

The technical field relates generally to an apparatus and method related to the use of pressure washing tools or surface cleaning devices.

Background Information

A variety of surface cleaners are known which expel pressurized water onto a surface to clean the surface. Some of these cleaners include nozzle assemblies which rotate as water is expelled as high pressure water jets from nozzles of the nozzle assemblies during the cleaning process. While the rotation of such nozzle assemblies have previously been driven by pneumatic or other systems, there remains a need for improvement in this area.

SUMMARY

In one aspect, a surface cleaner may comprise a frame; a rotatable platform mounted on the frame; and a nozzle assembly mounted on the platform; wherein the nozzle assembly rotates relative to the platform in response to rotation of the platform relative to the frame.

In another aspect, a surface cleaner may comprise a frame; a water feed line; a rotatable platform mounted on and rotatable relative to the frame; a first water swivel having a first portion and a second portion which is rotatable relative to the first portion, wherein the first portion is connected to the water feed line and the second portion is mounted on and rotatable with the platform; an essentially circular perimeter of the frame; a drive train wheel assembly which is mounted on and rotatable relative to the platform and which comprises an axle, a first drive wheel secured to the axle and a second drive wheel secured to the axle, wherein the first drive wheel engages the essentially circular perimeter of the frame; a second water swivel which is mounted on and rotatable with the platform and which has a first portion and a second portion which is a nozzle assembly rotatable relative to the first portion; a conduit extending from an outlet of the second portion of the first water swivel to an inlet of the first portion of the second water swivel; a drive shaft conduit of the nozzle assembly; a third drive train wheel secured to the drive shaft conduit; and a drive loop which engages the second and third drive train wheels.

In another aspect, a method may comprise the steps of rotating a rotatable platform relative to a frame of a surface cleaner to cause rotation of a nozzle assembly which is rotatably mounted on the platform and comprises a nozzle; and moving water through the nozzle to form a water jet which impacts a target surface.

BRIEF DESCRIPTION OF THE SEVERAL VIEWS OF THE DRAWINGS

A sample embodiment is set forth in the following description, is shown in the drawings and is particularly and distinctly pointed out and set forth in the appended claims.

Similar numbers refer to similar parts throughout the drawings.

DETAILED DESCRIPTION

Figure 1:
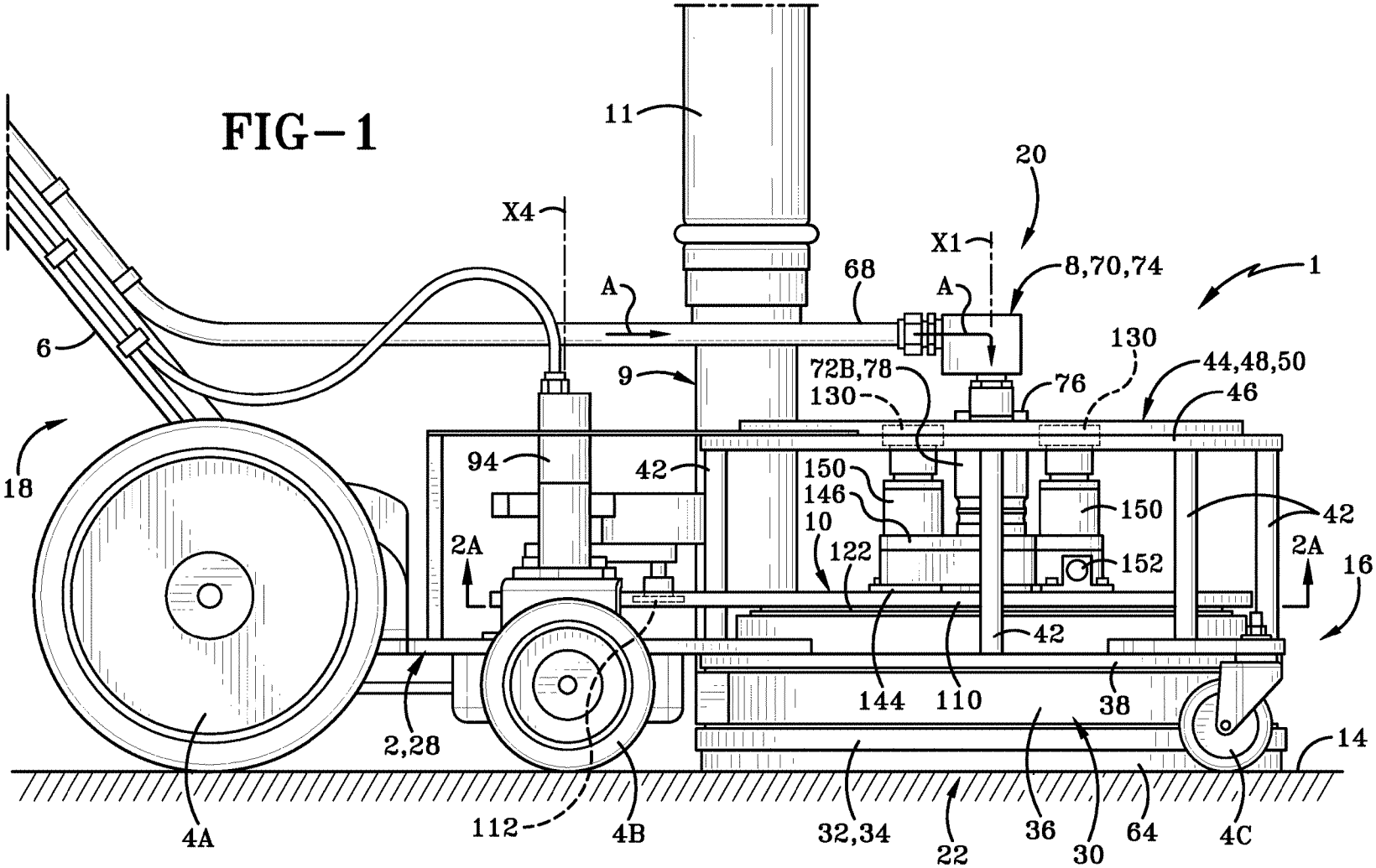
FIG. 1 is a side elevation view of the surface cleaner with portions removed.
Figure 2:
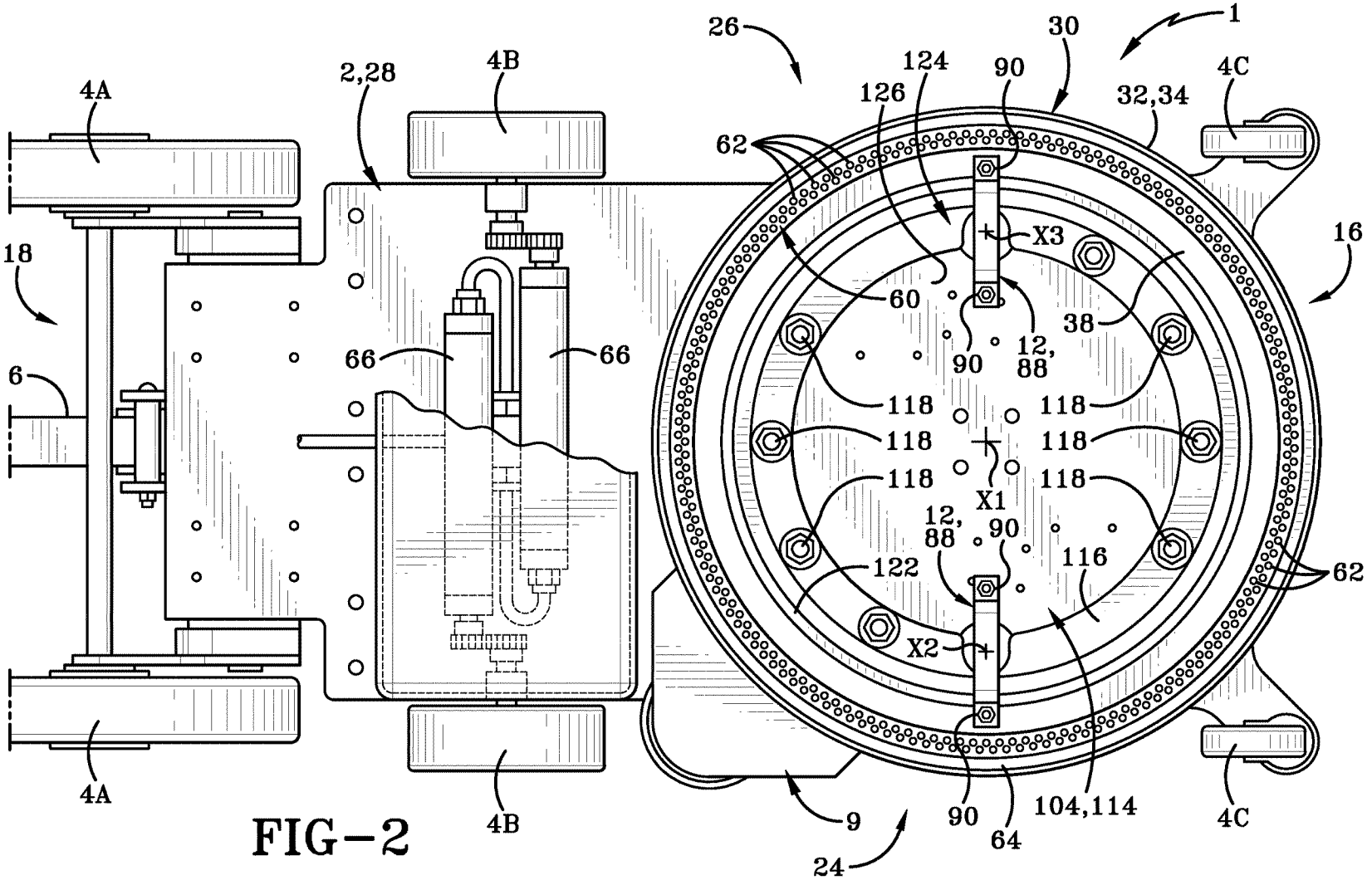
FIG. 2 is a bottom plan view of the surface cleaner shown in FIG. 1.
Figure 3:
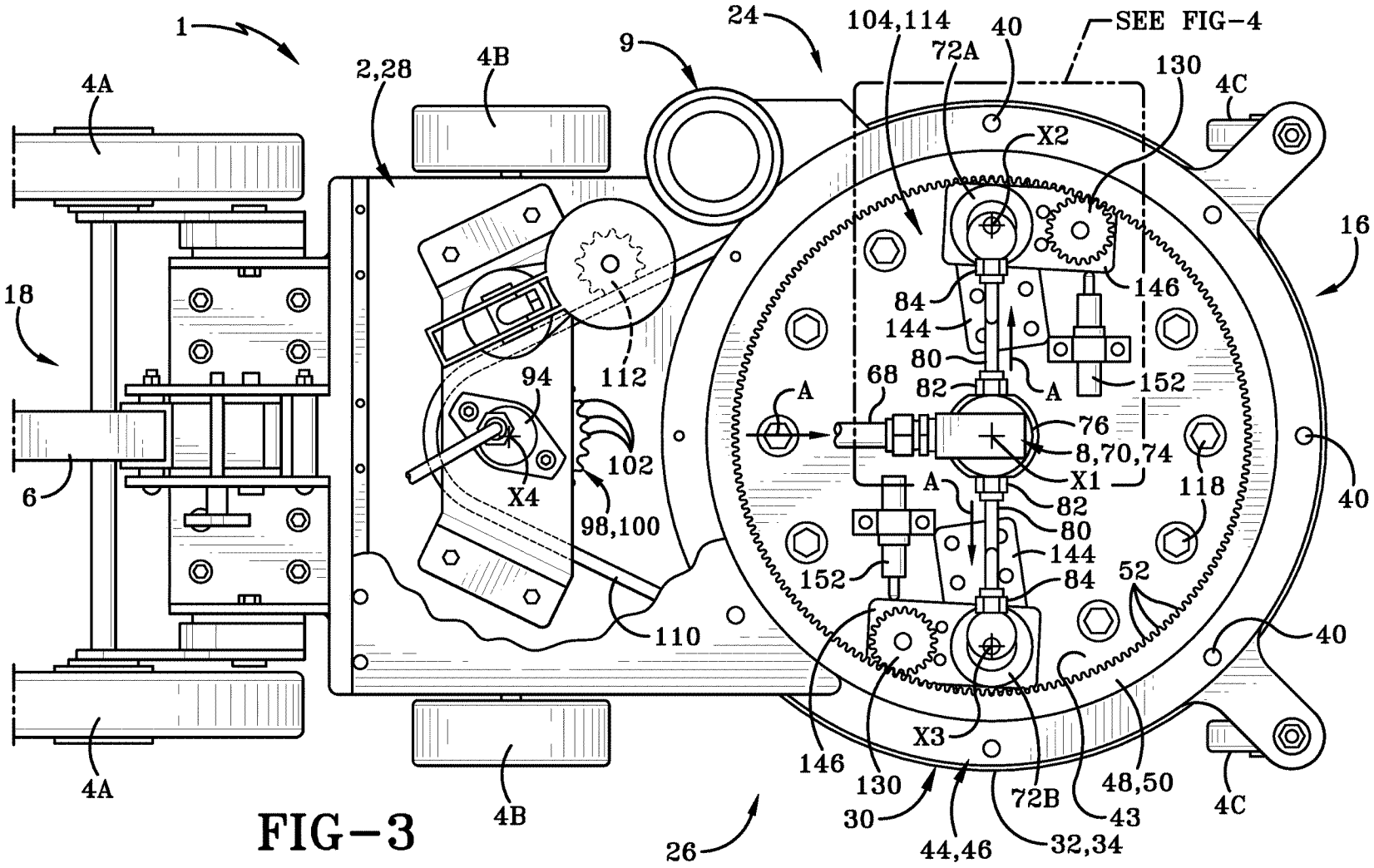
FIG. 3 is a top plan view of the surface cleaner of FIG. 1.
Figure 4:
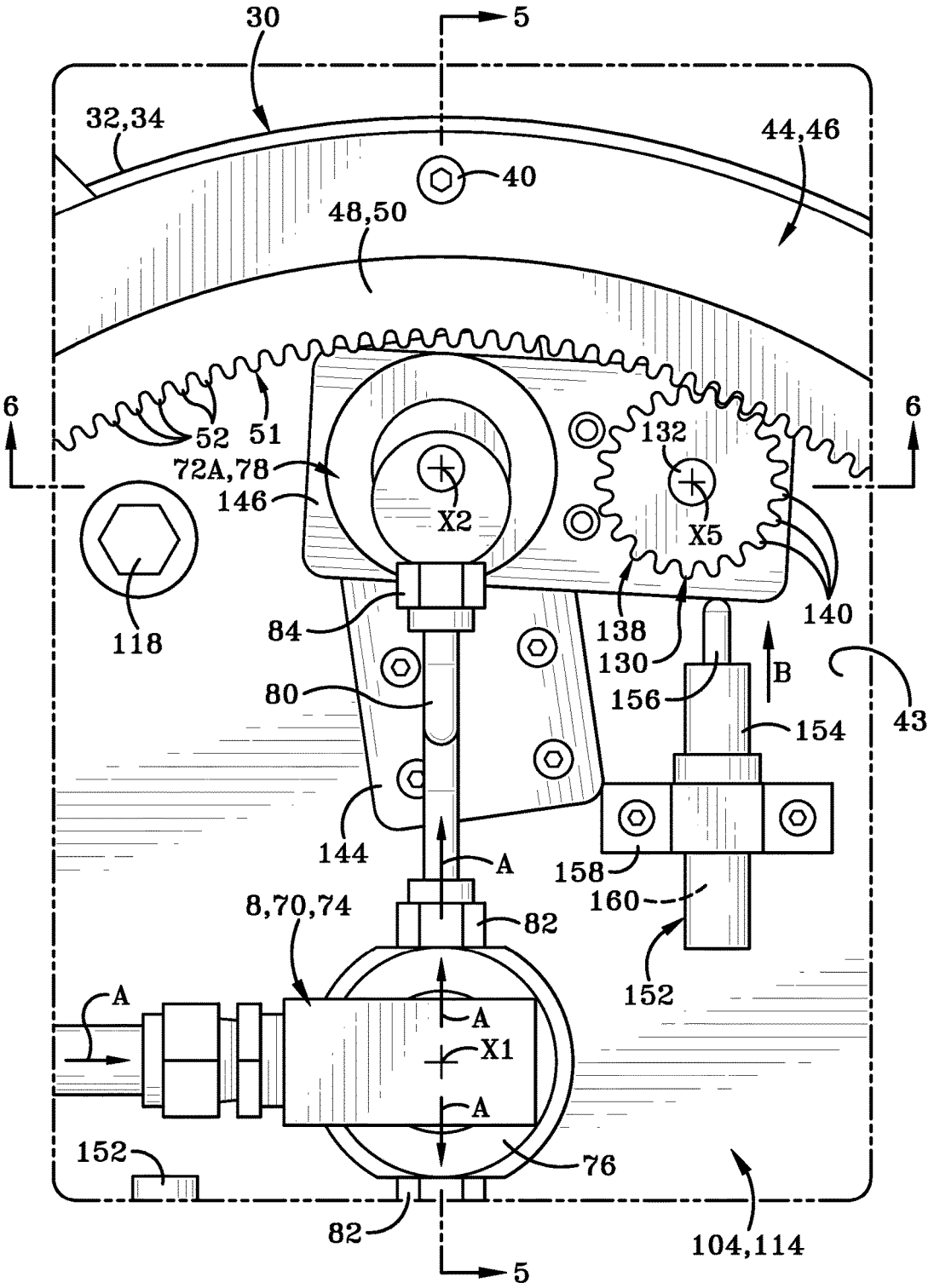
FIG. 4 is an enlarged view of the encircled portion of FIG. 3.

A surface cleaning device or surface cleaner is shown generally at 1 in FIGS. 1-3. Cleaner 1 may include a rigid frame 2, a plurality of wheels 4A-4C which are rotatably mounted on the frame, a handle 6 which is mounted on the frame extending rearwardly therefrom (only a portion shown), a water system or assembly 8 and a nozzle assembly drive train 10 configured to rotate nozzle assemblies 12 (FIG. 2) of the water assembly 8. Nozzle assemblies 12 are configured to eject or shoot water jets onto a target surface 14 to be cleaned. Cleaner 1 may include a vacuum system or assembly 9 which may include a vacuum hose 11.

Cleaner 1 and/or frame 2 may have a front 16 and a back 18 defining therebetween a longitudinal direction, a top and bottom 20 and 22, and left and right sides 24 and 26 defining therebetween an axial direction of the cleaner or frame. Wheels 4A are rotatably mounted adjacent the rear ends 18 of frame 2 to rotate about a common horizontal axis which extends in the axial direction from left to right. Likewise, wheels B may be rotatably mounted on frame 2 along a rear section thereof and forward of wheels 4A to rotate about a horizontal axis which may be parallel to the axis about which wheels 4A are rotatable. Wheels 4B may be drive wheels for driving the forward and rearward movement of cleaner 1 along surface 14. The front wheels 4C may be caster wheels such that they are rotatably mounted on a caster bracket to rotate about a horizontal axis with the caster bracket being rotatably mounted about a vertical axis on frame 2 adjacent front end 16 thereof. Wheels 4 are thus ground-engaging or surface-engaging wheels which engage ground or surface 14. Only a portion of handle 6 is shown for simplicity. It is well-known in the art that various controls may be mounted on handle 6 in order to control the various operations of cleaner 1, such as a control of the forward and rearward movement of the cleaner via drive wheels 4B, the flow of water through water system 8 to provide the cleaning water jets, and/or other motors or actuators such as pneumatic motors, hydraulic motors or electric motors.

Frame 2 may include a rear section 28 and a front section 30 which is secured to and extends forward from the front of rear section 28 to the front or front end 16. Front section 30 of frame 2 may include an annular sidewall 32 which may be circular as viewed from above and which may include a lower or skirt ring 34, an intermediate ring 36 which is secured to and extends upwardly from lower ring 34, and an upper or bearing ring 38 which is secured to and extends upwardly from intermediate ring 36. Lower ring 34 and intermediate ring 36 may be secured to one another by various fasteners or screws 40 (FIG. 5), and likewise upper ring 38 and intermediate ring 36 may be secured to one another by various fasteners or screws 40 or the like. Front section 30 may further include a plurality of uprights or posts 42 which are rigidly secured to and extend upwardly from upper ring 38. The same fasteners or screws 40 which are used to secure intermediate ring 36 to upper ring 38 may likewise be used to secure rings 36 and 38 and posts 42 to one another. Posts 42 may lie along a common circle as viewed from above and may be positioned around a space 43 (FIGS. 3, 5) which may extend upwardly from adjacent the bottom of posts 42 to adjacent the top of posts 42. Space 43 may extend upwardly from adjacent the top of sidewall/ring 38 and upwardly above the top of sidewall 32/ring 38. An upper portion of sidewall 32/ring 38 may be disposed in space 43.

Front section 30 may further include a drive train ring assembly or gear ring assembly 44 which may include an annular mounting flange 46 and a drive train ring or gear ring 48. Ring assembly including flange 46 and ring 48 may be spaced upwardly of the top of sidewall 32 and ring 38 adjacent the top of space 43 along the outer perimeter of space 43. Portions of flange 46 and/or ring 48 may be directly above portions of sidewall 32. Ring assembly 44 may be rigidly secured to the top of posts 42 such as by a plurality of fasteners or screws 40 which may extend from flange 46 to a respective post 42. Ring 48 may be secured to and extend radially inwardly from flange 46. Both flange 46 and ring 48 may be circular as viewed from above and may be essentially horizontal as viewed from the side. Ring 48 may include an annular wall 50 with a plurality of gear teeth 52 extending therefrom. Annular wall 50 may have an essentially circular inner perimeter 51 along which gear teeth 52 may be formed. In the sample embodiment, gear teeth 52 extend along the entire circumference of annular wall 50 and may extend radially inwardly therefrom as shown in the figures although teeth 52 may extend in other directions. For instance, a ring similar to ring 48 may be formed with a set of teeth extending radially outward from an annular wall such that the set of teeth extend along an essentially circular outer perimeter of the annular wall or ring. Similar teeth may also extend downwardly, upwardly or at various angles from an annular wall of a ring analogous to ring 48 (for instance, the ring may be a beveled gear ring with teeth extending outwardly from an annular wall at about 30 or 45 or 60 degrees or another angle relative to horizontal or vertical). Gear teeth 52 may be in any of these cases arranged along a circle or circular path as viewed from above. The inner circumference or perimeter 51 of gear ring 48 or gear teeth 52 define therewithin a generally horizontal space 54 which may be circular as viewed from above. Space 54 may have a top or top entrance opening 56 and a bottom or bottom entrance opening 58 inasmuch as space 54 opens upwardly and downwardly.

A skirt 60 may be secured to and extend downwardly from the bottom of skirt ring 34 and may include multiple bristles 62 arranged generally in an annular or circular fashion as viewed from below. Skirt 60 may also include a seal 64 which may be formed of an elastomer or plastic material for example. Seal 64 may have an annular circular configuration as well. The bottom of skirt 60 may be closely adjacent or in contact with target surface 14 when cleaner 1 is being used to clean surface 14.

One or more wheel drive motors or actuators 66 (FIG. 2) may be mounted on a rear section 28 of frame 2 and may be operatively connected to drive wheels 4B in order to drive rotation of wheels 4B to effect forward, rearward or other movement of cleaner 1 along surface 14. Motors or actuators 66 may be for example pneumatic, hydraulic or electric motors or actuators.

Water system or assembly 8 may include a source of water with a pump which is in fluid communication with nozzle assemblies 12 via various conduits and water swivels. Assembly 8 may include a main water feed line 68 which may extend over a portion of flange 46, ring 48 and space 54 and which may be connected at a front end thereof to an inlet of a central water swivel 70. There may be one or more additional water swivels such as swivels 72A and 72B which may be spaced from one another and swivel 70 such that swivel 70 is generally or directly between swivels 72A and 72B. Swivels 72 may be referred to as nozzle assembly water swivels. Swivel 70 may have an upper or first swivel portion 74 and a second or lower swivel portion 76 such that portion 74 is rotatable relative to portion 76 about a vertical axis X1. Each of swivels 72 has a first or upper swivel portion 78 and a second or lower swivel portion which is also the corresponding nozzle assembly 12 such that portion or assembly 12 of swivel 72A is rotatable relative to portion 78 of swivel 72A about a vertical axis X2 and portion or assembly 12 of swivel 72B is rotatable relative to portion 78 of swivel 72B about a vertical axis X3. Thus, each of axes X1, X2 and X3 may be parallel to one another and may also lie in a common vertical plane. Part of or a majority of lower portion 76 of swivel 70 may be in space 43. Likewise, part of or a majority of upper portion 78 of each swivel 72A and 72B may be in space 43.

A pair of water conduits 80 may be connected to and extend between respective outlets 82 of swivel portion 76 of swivel 70 and respective inlets 84 of portions 78 of swivels 72A and 72B. Each nozzle assembly 12 may include a nozzle assembly drive shaft conduit 86, a nozzle arm or bar 88 and a plurality of nozzles 90. The water system or water assembly components thus define respective water passages or water flow passages which form a water flow pathway such that this pathway and the water flow are represented by Arrows A in FIGS. 1 and 3-6. More particularly, when water is being pumped through the water system, water may flow from a source of water through feed line 68 and into the main swivel 70 through the inlet of portion 74 of swivel 70, through swivel 70 and the outlets 82 thereof, through conduits 80 and inlets 84 of the respective swivel 72A and 72B, through swivels 72A and 72B into and through nozzle assemblies 12 including conduit 86 and bar 88, and out of the respective nozzles 90 as water jets which impact target surface 14 to clean surface 14.

A drive train wheel or sheave 92 may be mounted on conduit 86 and extend radially outwardly therefrom, and may have an essentially circular outer perimeter 93. Conduit 86 may be essentially vertical and have a portion extending upwardly within portion 78 of the given swivel 72 and a portion which extends downwardly below and out of portion 78 of a given swivel 72. Nozzle arm or bar 88 may be secured to the bottom of conduit 86 and extend radially outwardly therefrom and may be essentially horizontal. Bar 88 may have portions that extend in opposite directions from one another away from the connection with conduit 86. Nozzles 90 may be secured to and extend downwardly from arm 88 such that nozzles are spaced radially outwardly of conduit 86. Nozzles 90 ay be directed downwardly and toward target surface 14 when cleaner 1 is in its operational position with its bottom against or adjacent surface 14, which may include the various wheels 4 being in contact with surface 14 and skirt 60 adjacent or in contact with surface 14.

As viewed from above, swivels 70 and 72 and conduits 80 may be or extend within the circles or vertical cylinders defined by the inner perimeters of sidewall 32, flange 46, ring 48, and swivel 70 may be at the center of said circles or vertical cylinders. Part of or a majority of each conduit 80 may be in space 43. Portions of swivels 70 and 72 and conduits 80 may extend within space 54, and/or above space 54 and flange 46 and ring 48, and/or below space 54 and flange 46 and ring 48.

The water system or assembly, including the various conduits, water swivels and nozzle assemblies, may be essentially the same as or similar to those described in U.S. Patent Application Publication 2013/0118529 of Gromes Sr., which is incorporated herein by reference.

Figure 2A:
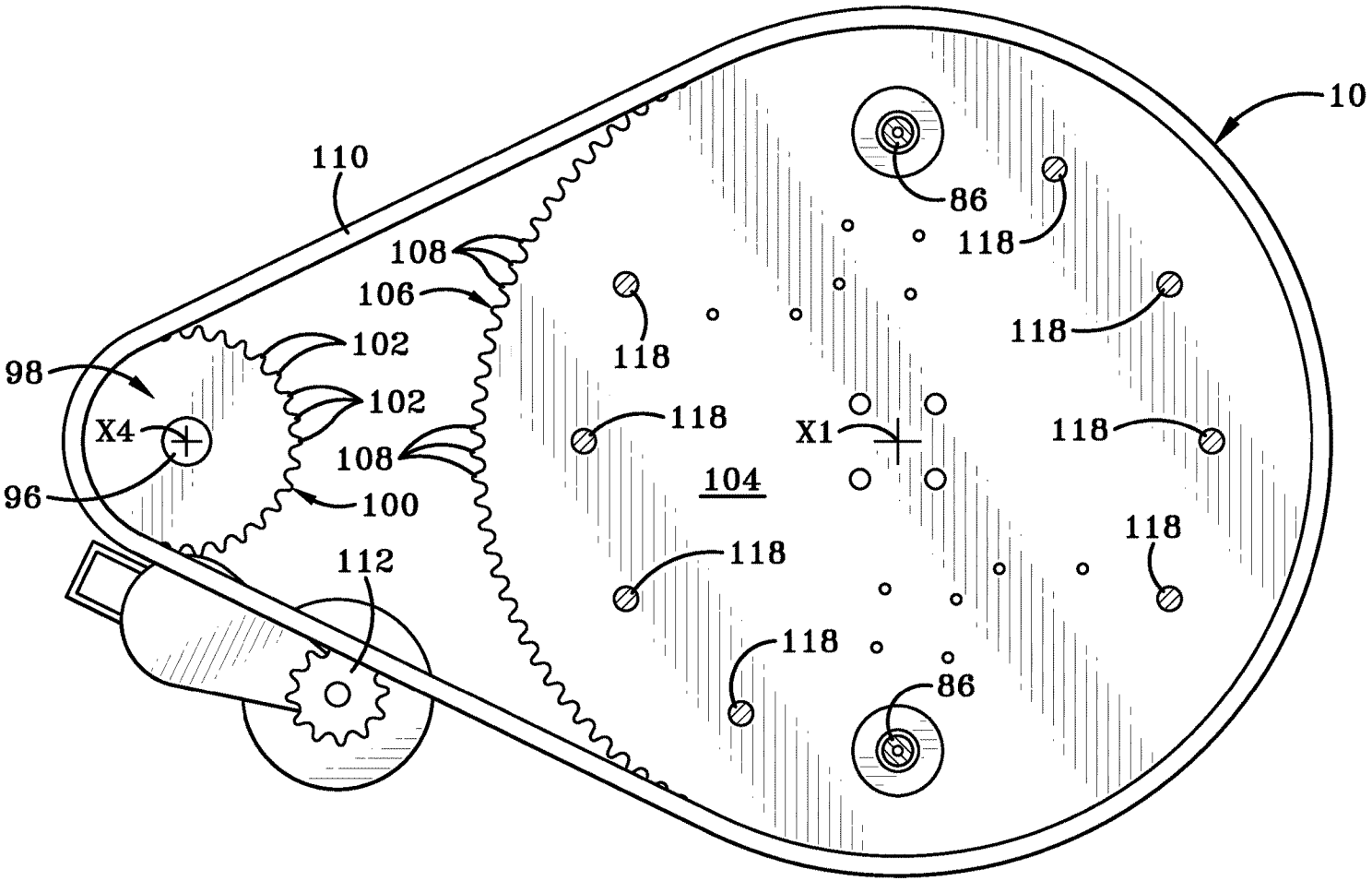
FIG. 2A is a diagrammatic sectional view taken on line 2A-2A of FIG. 1 showing part of the drive train.

Nozzle assembly drive train 10 is now described in greater detail. A motor 94 (FIGS. 1, 3) may be provided to drive rotation of nozzle assemblies 12 via drive train 10. Motor 94 may be a pneumatic motor, a hydraulic motor or an electric motor, for example. Motor 94 may be secured to rear section 28 of frame 2 and have a rotational output or drive shaft 96 (FIG. 2A) which may be rotatable about a vertical axis X4 (FIGS. 1, 2A, 3). With primary reference to FIG. 2A, drive train 10 may include a drive train wheel 98 having an essentially circular outer perimeter 100. Wheel 98 may include sprocket teeth 102 all along the outer perimeter 100 thereof. Wheel 98 may be rigidly secured to and extend radially outwardly from rotational output 96 such that wheel 98 may rotate with output 96 about axis X4. Outer perimeter 100 may be concentric about axis X4.

Drive train 10 may further include a drive train plate or wheel 104 which may be positioned to rotate about axis X1. Drive train wheel 104 may be substantially horizontal and may have an essentially circular outer perimeter 106 which may be essentially concentric about axis X1. Wheel 104 may be entirely higher than the top of sidewall 32. Wheel or plate 104 may include a set of multiple teeth 108 all along its outer perimeter 106. Perimeter 106/set of teeth 108 may in its entirety extend adjacent sidewall 32 and may be directly above or higher than sidewall 32.

Drive train 10 may further include a flexible drive loop 110 which may be a closed loop in the form of a chain or flexible belt. Drive loop 110 may extend from rearward of the back of sidewall 32 forward to adjacent the front of sidewall 32 and front end 16 of frame 2/cleaner 1. Drive loop 110 may also extend adjacent the left and right sides of sidewall 32 and left and right sides 24 and 26 of frame 2/cleaner 1. Drive loop 110 may be looped around wheels 98 and 104 and may engage said wheels along their outer perimeters 100 and 106. Loop 110 may engage teeth 102 and 108 when wheels 98 and 104 include such teeth. The rotation of wheel 98 causes or drives rotation of wheel 104 via drive loop 110, which is caused to revolve by the rotational movement of wheel 98. Said in another way, the rotational movement of drive train wheel 98 may be translated to rotational movement of drive loop 110, which may be translated to rotational movement of wheel 104. Drive train wheel 104 typically has a substantially larger diameter than drive train wheel 98, and may have a diameter which is at least two or three times that of wheel 98. A tensioner wheel 112 may be provided to engage loop 110 to provide sufficient tension to loop 110.

Figure 5:
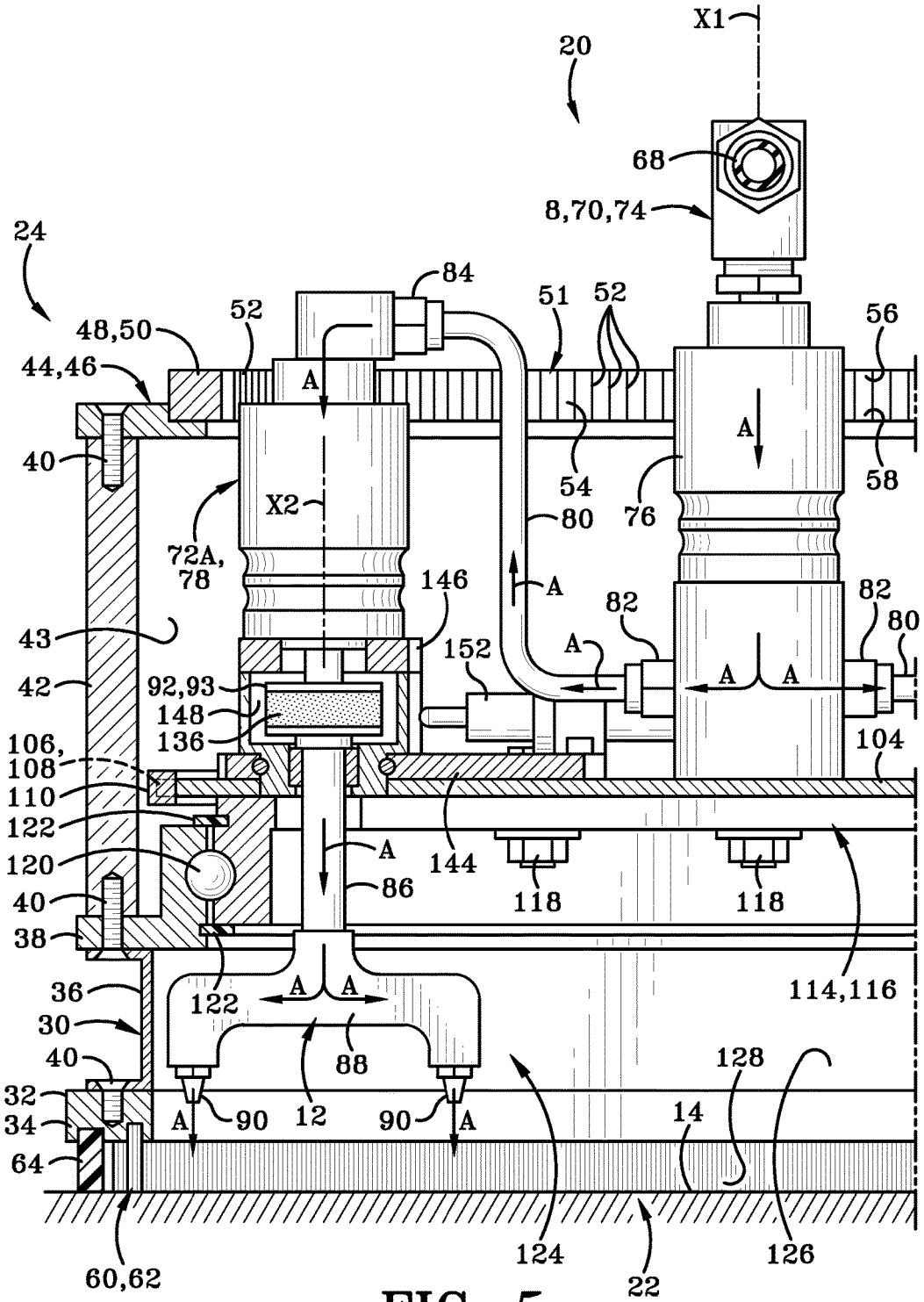
FIG. 5 is a sectional view taken on line 5-5 of FIG. 4.

With primary reference to FIG. 5, wheel 104 may be part of a rotatable platform 114 which may also include a bearing ring 116 with a plurality of fasteners 118 which rigidly secure ring 116 to wheel 104. Fasteners 118 may include threaded bolts which pass through corresponding holes in plate 104 and ring 116, along with nuts which threadedly engage the bolts. Ring 116 may extend downwardly from the bottom of plate 104 adjacent and spaced inwardly of the outer perimeter 106/teeth 108 of plate 104 such that outer perimeter 106/teeth 108 extend radially outwardly beyond the outer perimeter of ring 116. Rotatable platform 114 may be rotatably mounted on front section 30 of frame 2 by a plurality of roller bearings or ball bearings 120 (only one shown in FIG. 5) which are positioned along the circular outer perimeter of bearing ring 116 and along the circular inner perimeter of bearing ring 38. Upper and lower annular seals 122 may be provided directly above and below the bearings 120 to help prevent water and other undesired materials from entering the space between the inner perimeter of bearing ring 38 and outer perimeter of bearing ring 116. Seal 122 may be formed of an elastomeric material or other suitable material.

Platform 114 and sidewall 32 of front section 30 may together form a nozzle assembly housing 124 which defines a nozzle assembly housing cavity 126 having a bottom entrance opening 128. Wheel/plate 104 may define the top of cavity 126, and the inner surface of sidewall 32 may define the outer perimeter of cavity 126. Vacuum hose 11 may be in fluid communication with nozzle assembly housing cavity 126. Nozzle assembly conduits 86 may extend downwardly from above plate 104 and ring 116 through respective through holes in plate 104 and ring 116 to below plate 104 and ring 116 within cavity 126 such that a portion of each conduit 68 is above platform 114, a portion within one of the through holes in platform 114 and a portion below platform 114 within cavity 126. Bar 88 and nozzles 90 of nozzle assemblies 12 may be entirely within cavity 126 adjacent sidewall 32.

Various components are mounted on rotatable platform 114 and thus rotatable therewith about axis X1. These components may include portion 76 of swivel 70, swivel 72A and 72B, conduits 80 and various components of drive train 10. Portion 76 of swivel 70 may be secured to wheel 104 of platform 114 and extend upwardly therefrom. Similarly, portion 78 of each swivel 72 may be secured to wheel 104 of platform 114 and extend upwardly therefrom.

Figure 6:
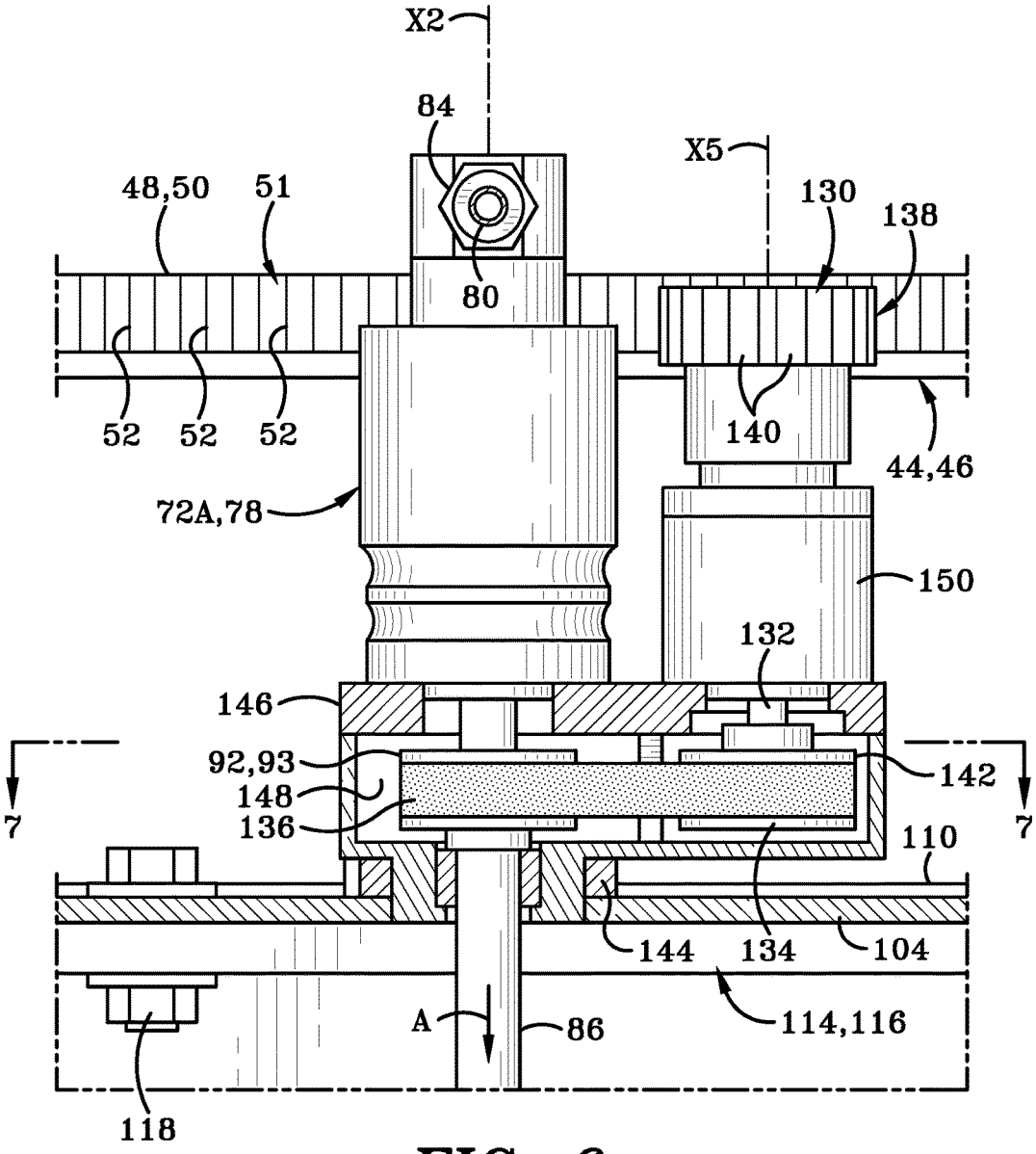
FIG. 6 is a sectional view taken on line 6-6 of FIG. 4.
Figure 7:
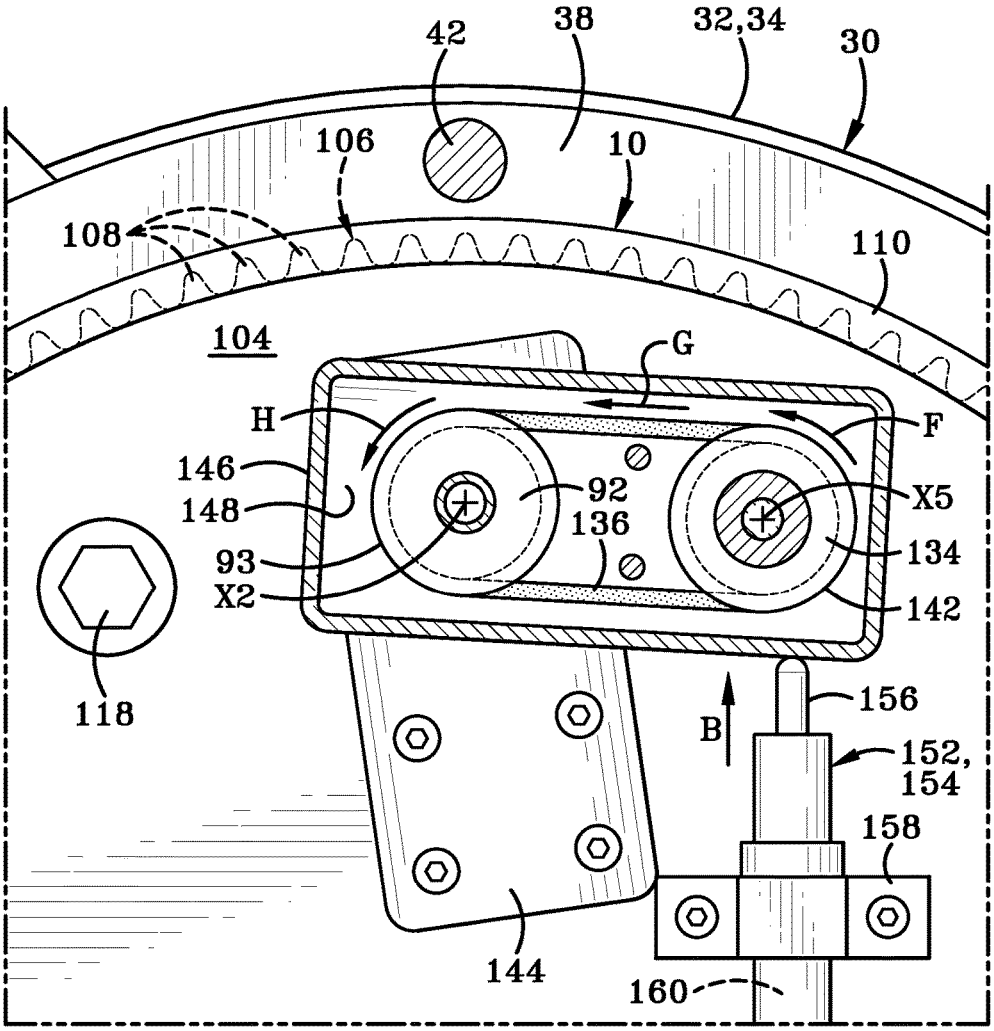
FIG. 7 is a sectional view taken on line 7-7 of FIG. 6.

With primary reference to FIG. 6, drive train 10 may further include a drive train wheel or gear or pinion 130, a drive shaft or axle 132, a drive train wheel or sheave 134 and a flexible drive loop 136. Wheel 130 may be rigidly secured to axle 132 and extend radially outwardly therefrom adjacent a top end of axle 132. Wheel 134 may be rigidly secured to and extend radially outwardly from axle 132 adjacent a lower end of axle 132. Thus, wheels 130 and 134 may rotate together with axle 132 about a vertical axis X5 which may be parallel to the other axes X1, X2, X3 and X4. Each set of wheels 130 and 134 and a given axle 132 together may be referred to as a drive train wheel assembly or a pinion assembly which is rotatable about axis X5. Wheel 130 may have an essentially circular outer perimeter 138 and may have formed along perimeter 138 gear teeth 140 extending around the entire perimeter 138. Wheel 134 may have an essentially circular outer perimeter 142. In the sample embodiment, gear teeth 140 may extend radially outwardly as shown in the figures although teeth 140 may extend in other directions. For instance, a wheel similar to wheel 130 may be formed with a set of teeth extending downwardly, upwardly or at various angles (for instance, the wheel may be a beveled gear with teeth extending outwardly at about 30 or 45 or 60 degrees or another angle relative to horizontal or vertical).

With primary reference to FIGS. 3-6, wheel 130 may be within or adjacent space 54 and in engagement with ring 48 of front section 30 of frame 2. Outer perimeter 138 of wheel 130 may be in contact with or engage inner perimeter 51 of ring 48. Where inner perimeter 51 includes gear teeth 52 and outer perimeter 138 includes gear teeth 140, teeth 52 and 140 may engage or mesh with one another. Drive loop 136 may engage and be looped around wheels 92 and 134 such that rotation of shaft 132 and wheels 130 and 134 about axis X5 causes revolution or revolving movement of drive loop 136 which in turn causes rotation of wheel 92 and nozzle assembly 12 including shaft or conduit 86, bar 88 and nozzles 90. Wheels 92 and 134 may be sheaves such that drive loop 136 may be a flexible drive belt which engages sheaves 92 and 134 generally along or adjacent outer perimeters 93 and 142. Likewise, wheels 92 and 134 may be sprockets having teeth such that drive loop 136 may be a chain which engages the teeth of the sprockets along the outer perimeters 93 and 142 thereof. Wheels 92 and 134 and axle 132 may be in or extend within space 43. Wheel 130 may extend within or be adjacent an upper portion of space 43.

With primary reference to FIGS. 3-6 and 7, various components are mounted on rotatable platform 114 and rotate therewith about axis X1. In addition to swivels 72A and 72B and portion 76 of swivel 70, these components may include a pair of mounting blocks or plates 144 and a corresponding pair of rigid chambers 146 which are pivotally mounted on plate 104 via mounting plate 144 to respectively pivot about axes X2 and X3 relative to platform 114. Each mounting block 144 may be rigidly secured to plate 104 such as by various bolts or fasteners or other means known in the art and may extend upwardly therefrom within a lower portion of space 43. Each chamber 146 may also be in or extend within space 43. Chamber 146 has a top wall, bottom wall and sidewall which define therewith an interior chamber 148 (FIGS. 5-7) in which may be disposed wheels 92 and 134 along with drive loop 136. In addition, a lower end of shaft 132 is disposed in interior chamber 148, as is a portion of shaft or conduit 86. Portion 78 of swivel 72A is secured to and extends upwardly from the top wall of one of chambers 146. Likewise, portion 78 of swivel 72B is secured to and extends upwardly from the top wall of the other chamber 146. Also amongst the components which may rotate with platform 114 are a pair of axle housings 150 which may be secured to and extend upwardly from the top walls of respective chambers 146 within space 43. Axles 132 are rotatably mounted on and pass through one of axle housings 150. Each housing 150 along with its drive train wheel assembly and walls of chamber 146 may be rotatable relative to platform 114. Also amongst the components which may rotate with platform 114 may be a pair of biasing units 152 each which may be mounted on the top of plate 104 and extend upwardly therefrom within space 43. Each unit 152 may include a first member or cylinder 154, a second member or piston 156, a mount 158 and an internal spring 160. First member or cylinder 154 may be secured to plate 104 by mount 158 and bolts or other fasteners or the like. First member 154 may be secured so as to be fixed relative to plate 104. Second member 156 may be a movable member or piston which is movable relative to first member 154 and platform 114. First member 154 may be a cylinder or define an interior chamber in which a portion of the first member or piston 156 is disposed with a second portion thereof extending outwardly from the first member or cylinder. A spring 160 may be disposed within first member or cylinder 154 to bias the second member or piston 156 outward away from cylinder 154 and toward chamber 146. More particularly, the movable member or piston 156 may have a tip or surface which engages an outer surface of chamber 146 in order to bias wheel 130 toward or against ring 48, which may mean biasing perimeter 138 against perimeter 51 or teeth 140 against teeth 52. This biasing movement or direction is illustrated at Arrow B in FIGS. 4 and 7.

In order to clean surface 14 with cleaner 1, the operator may position cleaner 1 atop surface 14 with wheels 4 in contact with surface 14 and skirt 60 in contact or closely adjacent surface 14. The operator of cleaner 1 may then manipulate various controls typically located on handle 6 in order to cause water to flow through the water pathway represented by Arrows A as previously discussed in order to create water jets (lower Arrows A in FIG. 5) which are expelled through nozzles 90 to impact surface 14. As water is being ejected or forced through nozzles 90 onto surface 14, the vacuum system 9 may be operated to suction water out of housing cavity 126 through vacuum hose 11 and cleaner 1 may be moved along surface 14 via rolling on wheels 4.

Figure 8:
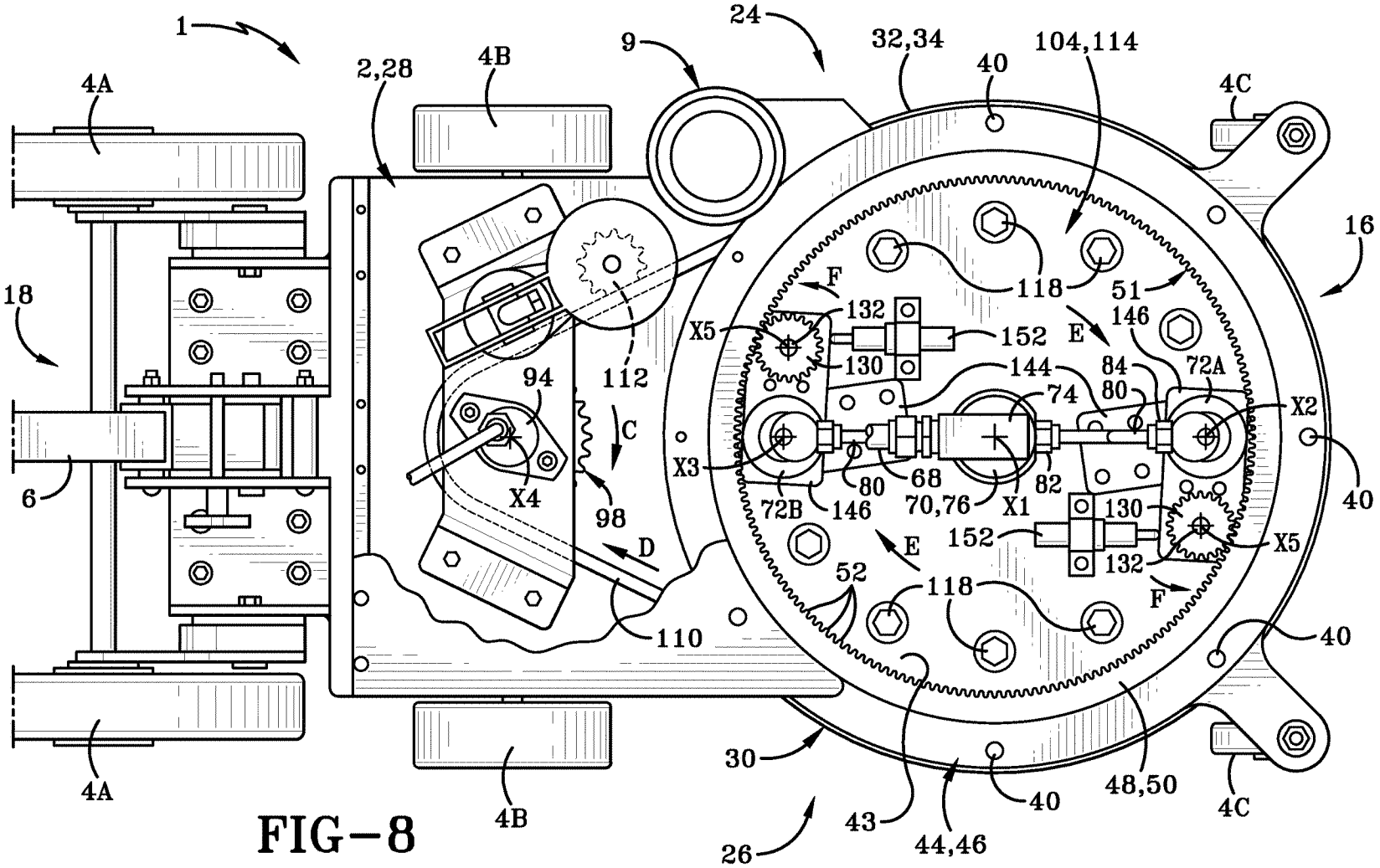
FIG. 8 is a top plan view similar to FIG. 3 showing the operation of various components.
Figure 9:
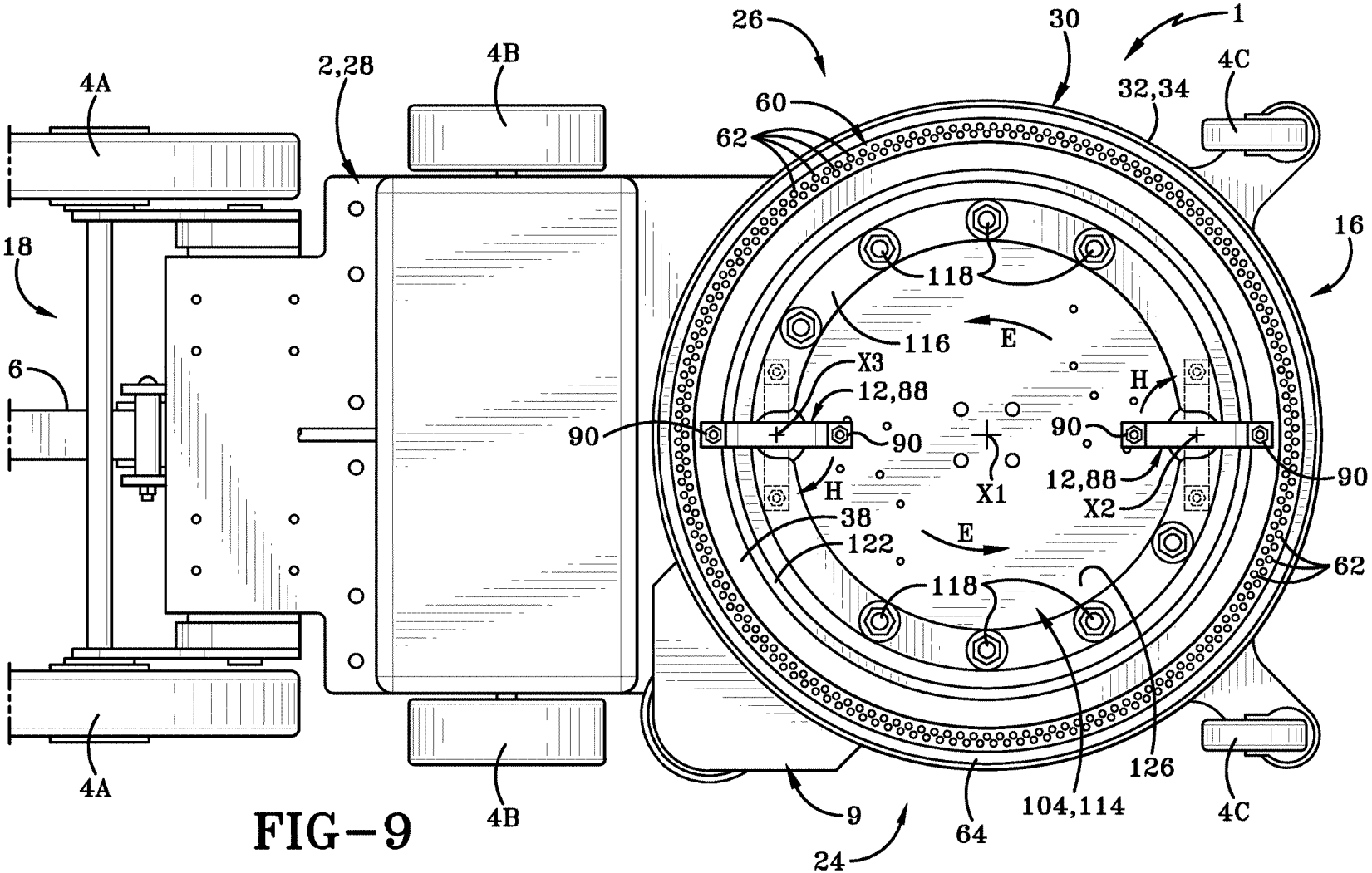
FIG. 9 is a bottom plan view similar to FIG. 2 showing the operation of various components.

While water is being directed through nozzles 90 onto target surface 14 and also being suctioned out of cavity 126 through hose 11, and while cleaner 1 is stationary or rolling on surface 14, nozzle assemblies 12 may be rotated about the respective axes X2 and X3 in response to the driving rotation of the rotational output 96 (FIG. 2A) of motor 94 (FIG. 8). Nozzle assemblies 12 may also rotate in response to rotation or revolving movement of the various components of drive train 10. More particularly and with primary reference to FIGS. 8 and 9, motor 94 may be operated or turned on to drive rotation of output or shaft 96 (FIG. 2A) to in turn drive the rotation of wheel 98 (Arrow C in FIG. 8) about axis X4. The rotation of wheel 98 in turn drives the revolution or revolving movement (Arrow D in FIG. 8) of drive belt 110 which in turn causes the rotation (Arrows E in FIGS. 8, 9) of rotatable platform 114 about axis X1. As previously noted, various components are rotatable with platform 114, whereby the rotation of platform 114 likewise includes the rotation of these various components, including swivels 72A and 72B, portion 76 of swivel 70, axles 132, wheels 130, wheels 134, wheels 92, mounting blocks 144, chambers 146, biasing units 152 and nozzle assemblies 12. The rotation of platform 114 and these various components mounted thereon or carried thereby may rotate in the same direction as wheel 98 and output 96. During the rotation of platform 114 about axis X1 as shown at Arrow C, the engagement between the outer perimeters 138/teeth 140 of respective wheels or gears 130 may engage the inner perimeter 51/teeth 52 of ring 48, thereby causing the rotation (Arrows F in FIGS. 7, 8) of wheels 130, axles 132 and wheels 134 about respective axes X5, wherein the same rotation represented by Arrows F may be the opposite direction as the rotation of the various components represented by rotation of Arrows E and Arrow C. Rotation of wheel 134 drives the revolution or revolving movement (Arrow G in FIG. 7) of drive loop 136, which in turn drives the rotation (Arrow H in FIG. 7) about axis X2 or X3 of the given wheel 92 and nozzle assembly 12 including the conduit 86, bar 88 and nozzles 90 thereof. The given wheel 92 and nozzle assembly 12 may thus rotate in the same direction as the components indicated by Arrow F.

The various components of drive train 10 may include drive train components which are upstream or downstream of other drive train components of drive train 10. Thus, rotation or revolving movement of a given relatively upstream drive train component which is upstream of a given relatively downstream drive train component may cause or drive the corresponding rotation or revolving movement of the given relatively downstream drive train component. It may also be said that a given relatively downstream drive train component which is downstream of a given relatively upstream drive train component may rotate or revolve in response to the corresponding rotation or revolving movement of the given relatively upstream drive train component.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the description and illustration set out herein are an example not limited to the exact details shown or described.

The invention claimed is:

1. A surface cleaner comprising:

a frame;

a motor mounted on the frame and having a drive shaft which is rotatable about a first axis;

a rotatable platform having an outer peripheral edge; said rotatable platform being mounted on the frame and being rotatable about a second axis that is different from the first axis; wherein the first axis is parallel to the second axis and is spaced a distance outwardly from the outer peripheral edge of the rotatable platform;

a nozzle assembly mounted on the platform;

a first water swivel comprising a first portion; wherein the nozzle assembly is a second portion of the first water swivel which is rotatable relative to the first portion;

a water feed line;

a second water swivel having a first portion and a second portion which is rotatable relative to the first portion, wherein the first portion of the second water swivel is connected to the water feed line and the second portion of the second water swivel is mounted on and rotatable with the platform;

a conduit extending from an outlet of the second portion of the second water swivel to an inlet of the first portion of the first water swivel;

an axle;

a first drive train wheel secured to the axle;

a second drive train wheel secured to the axle; wherein the axle, first drive train wheel and second drive train wheel rotate together;

a drive shaft conduit of the nozzle assembly;

a third drive train wheel secured to the drive shaft conduit;

a drive loop which engages the second and third drive train wheels;

a fourth drive train wheel secured to the drive shaft; and a drive loop engaging the fourth drive train wheel and the outer peripheral edge of the platform.

2. The surface cleaner of claim 1 further comprising an essentially circular perimeter of the frame; wherein the first drive train wheel engages the essentially circular perimeter of the frame.

3. The surface cleaner of claim 2 further comprising a biasing unit which biases the first drive train wheel toward engagement with the essentially circular perimeter of the frame.

4. The surface cleaner of claim 1 wherein the platform comprises a set of teeth; and further comprising a chain which engages the set of teeth.

5. The surface cleaner of claim 1 further comprising a drive train; wherein the nozzle assembly revolves relative to the second axis via the drive train; and the drive train comprises a drive train wheel assembly which is rotatable relative to the platform and which comprises an axle, a first drive wheel secured to the axle and a second drive wheel secured to the axle.

6. The surface cleaner of claim 5 further comprising a wall that is mounted on and pivotable relative to the platform; wherein the drive train wheel assembly is mounted on the wall.

7. A surface cleaner comprising:

a frame;

a motor mounted on the frame and having a drive shaft which is rotatable about a first axis;

a rotatable platform having an outer peripheral edge; said rotatable platform being mounted on the frame and being rotatable about a second axis that is different from the first axis; wherein the first axis is parallel to the second axis and is spaced a distance outwardly from the outer peripheral edge of the rotatable platform;

a nozzle assembly mounted on the platform;

a drive train; wherein the nozzle assembly revolves relative to the second axis and rotates relative to a third axis which is different from the first axis and the second axis via the drive train; and wherein the drive train comprises a first set of teeth of the frame and a pinion which engages the first set of teeth; and wherein the drive train comprises an axle on which the pinion is mounted, and a first sheave secured to the axle.

8. The surface cleaner of claim 7 wherein the drive train comprises a nozzle assembly drive shaft conduit and a second sheave mounted on the nozzle assembly drive shaft conduit; and the nozzle assembly is mounted on the nozzle assembly drive shaft conduit.

9. The surface cleaner of claim 7 wherein the drive train comprises a second set of teeth of the platform; and further comprising a chain which engages the second set of teeth.

* * * * *